US007222767B1

(12) United States Patent
Yang

(10) Patent No.: US 7,222,767 B1
(45) Date of Patent: May 29, 2007

(54) NAIL GUN WITH AN ADJUSTABLE CLIP ASSEMBLY

(75) Inventor: Yao-Te Yang, Dali (TW)

(73) Assignee: Besco Pneumatic Corp., Taichung Hsien (TW)

( * ) Notice: Subject to any disclaimer, the term of this patent is extended or adjusted under 35 U.S.C. 154(b) by 0 days.

(21) Appl. No.: 11/305,239

(22) Filed: Dec. 19, 2005

(51) Int. Cl.
*B25C 1/04* (2006.01)
*A45F 5/00* (2006.01)

(52) U.S. Cl. ..... 227/130; 227/156; 173/170; 173/171; 24/456; 224/269; 248/317; 248/680

(58) Field of Classification Search ..... 227/10, 227/130, 156; 173/217, 162, 170, 171; 248/322, 248/317, 324, 680, 692; 24/456, 457, 570; 224/269, 271
See application file for complete search history.

(56) References Cited

U.S. PATENT DOCUMENTS 4,406,064 A * 9/1983 Goss ..... 30/298.4
4,895,336 A * 1/1990 Lieberman ..... 248/690
5,332,156 A * 7/1994 Wheeler ..... 239/288
6,325,577 B1 * 12/2001 Anderson ..... 408/241 R
6,688,407 B2 * 2/2004 Etter et al. ..... 173/170
6,722,549 B2 * 4/2004 Shkolnikov et al. ..... 227/10
6,905,052 B2 * 6/2005 Sakai et al. ..... 224/269
7,108,079 B2 * 9/2006 Sakai et al. ..... 173/217

* cited by examiner

*Primary Examiner*—Scott A. Smith
(74) *Attorney, Agent, or Firm*—Rosenberg, Klein & Lee

(57) ABSTRACT

A pneumatic tool has a body, a handle, a clip, a biasing member and a cap. The handle is formed on and extends from the body and has a free end and an annular shank extending from the free end. The clip is rotatably and slidably mounted on the shank and has a collar and a clip tab. The collar is rotatably and slidably mounted around the annular shank and has multiple teeth formed on a side of the collar facing away from the body. The clip tab extends from the collar. The biasing member is mounted around the annular shank and has two ends abutting respectively with the handle and the collar. The cap is detachably attached to the shank and has multiple recesses respectively corresponding to and engaging with the teeth on the collar.

10 Claims, 6 Drawing Sheets

NAIL GUN WITH AN ADJUSTABLE CLIP ASSEMBLY

BACKGROUND OF THE INVENTION

1. Field of the Invention

The present invention relates to a nail gun, and more particularly to a nail gun with a clip assembly, wherein the position of the clip assembly on the tool can be adjusted.

2. Description of Related Art

To carry a nail gun conveniently, a clip is mounted on the tool to allow a user to hang the nail gun on a waist belt. With reference to FIG. 6, a conventional nail gun with a clip (44) substantially comprises a body (40), a handle (42), a nail magazine (43), a holding bar (44) and a clip (46). The handle (42) is formed on and extends from the body (40). The nail magazine (43) is attached to the body (40) for containing nail inside. The holding bar (44) is securely mounted between the handle (42) and the nail magazine (43), and the clip (46) is securely attached to the holding bar (44). Accordingly, the user can hang the nail gun on his/her waist belt with the clip (46).

However, the clip (46) is securely attached to the holding bar (44) and is not adjustable, such that the clip (46) is not versatile in use.

To overcome the shortcomings, the present invention tends to provide a nail gun with an adjustable clip assembly to mitigate or obviate the aforementioned problems.

SUMMARY OF THE INVENTION

The main objective of the invention is to provide a nail gun with a clip assembly, wherein the position of the clip assembly can be adjusted. The nail gun has a body, a handle, a nail magazine, a holding bar and a clip assembly. The handle is formed on and extending from the body. The nail magazine is attached to the body for containing nails inside. The holding bar is mounted between the handle and the nail magazine and has two ends and two mounting slots. The ends are securely attached to the handle and the nail magazine, respectively. The mounting slots are defined respectively in two sides of the holding bar to form a partition between the slots, and a through hole is defined through the partition and communicates with the slots. Each slot extends to a side edge of the holding bar to define an opening in the side edge. The clip assembly is rotatably and detachably attached to one of the mounting slots in the holding bar and has an axle, a clip, a positioning rod and a biasing member. The axle is rotatably and detachably attached to one of the mounting slots in the holding bar and has a front end, a rear end, a front hole and a rod hole. The front hole is axially defined in the front end of the axle. The rod hole is radially defined in the axle and communicates with the front hole. The clip is formed one and extends from the rear end of the axle. The positioning rod is slidably held inside the rod hole and has a front end extending into and out of front hole in the axle and selectively extending into the through hole in the partition of the holding bar. The biasing member is held inside the rod hole and abuts against the positioning rod to provide a biasing force to the positioning rod.

Other objects, advantages and novel features of the invention will become more apparent from the following detailed description when taken in conjunction with the accompanying drawings.

DETAILED DESCRIPTION OF PREFERRED EMBODIMENT

Figure 1:
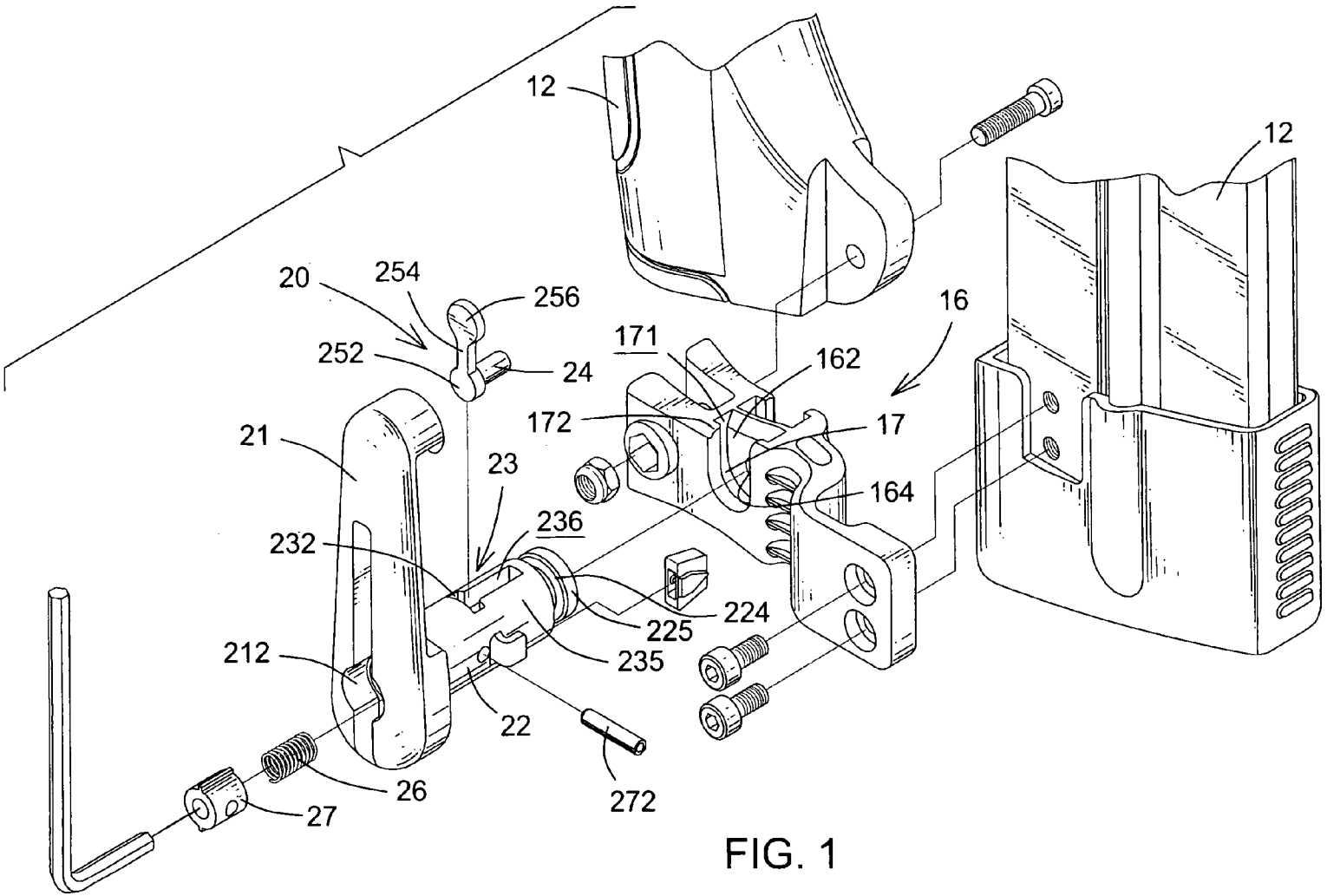
FIG. 1 is an exploded perspective view of a nail gun with an adjustable clip assembly in accordance with the present invention.
Figure 2:
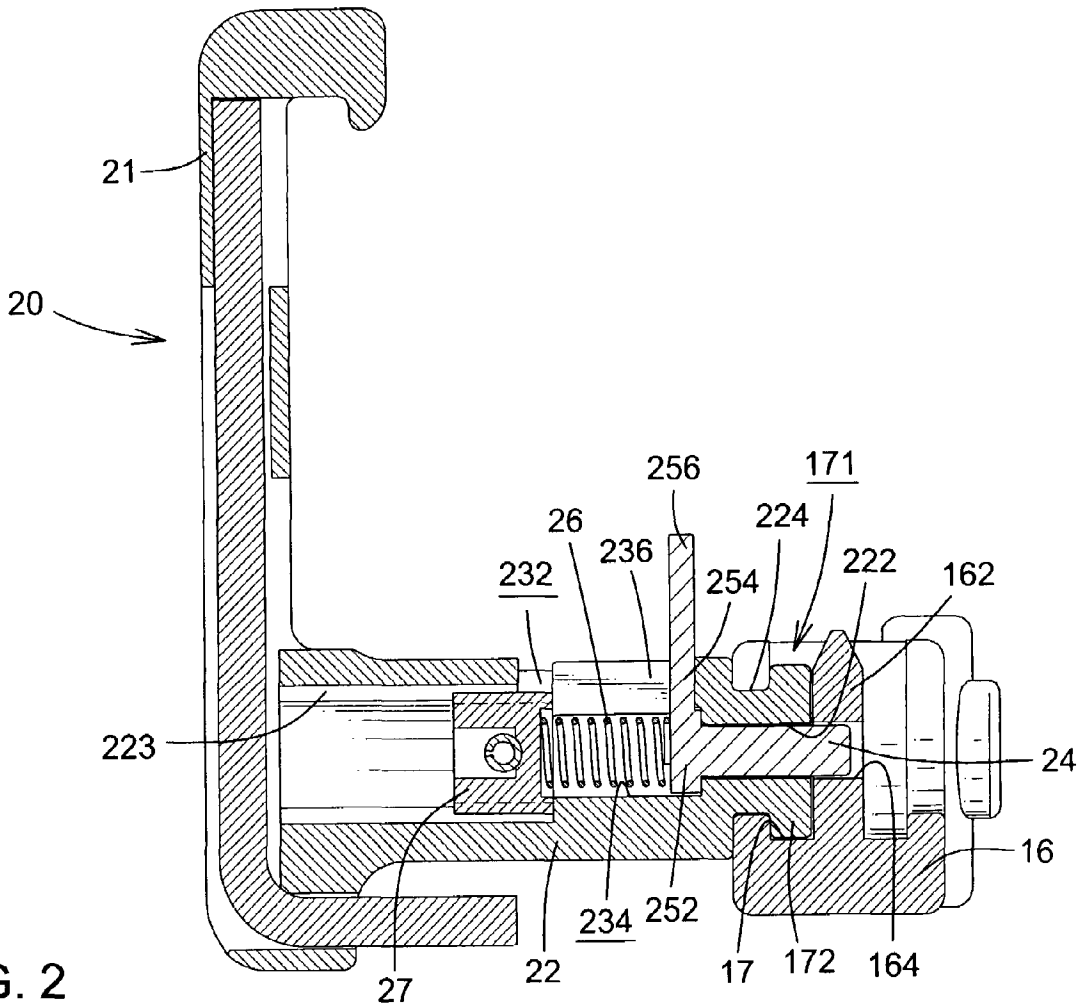
FIG. 2 is a cross sectional side plan view of the clip assembly in FIG. 1.
Figure 3:
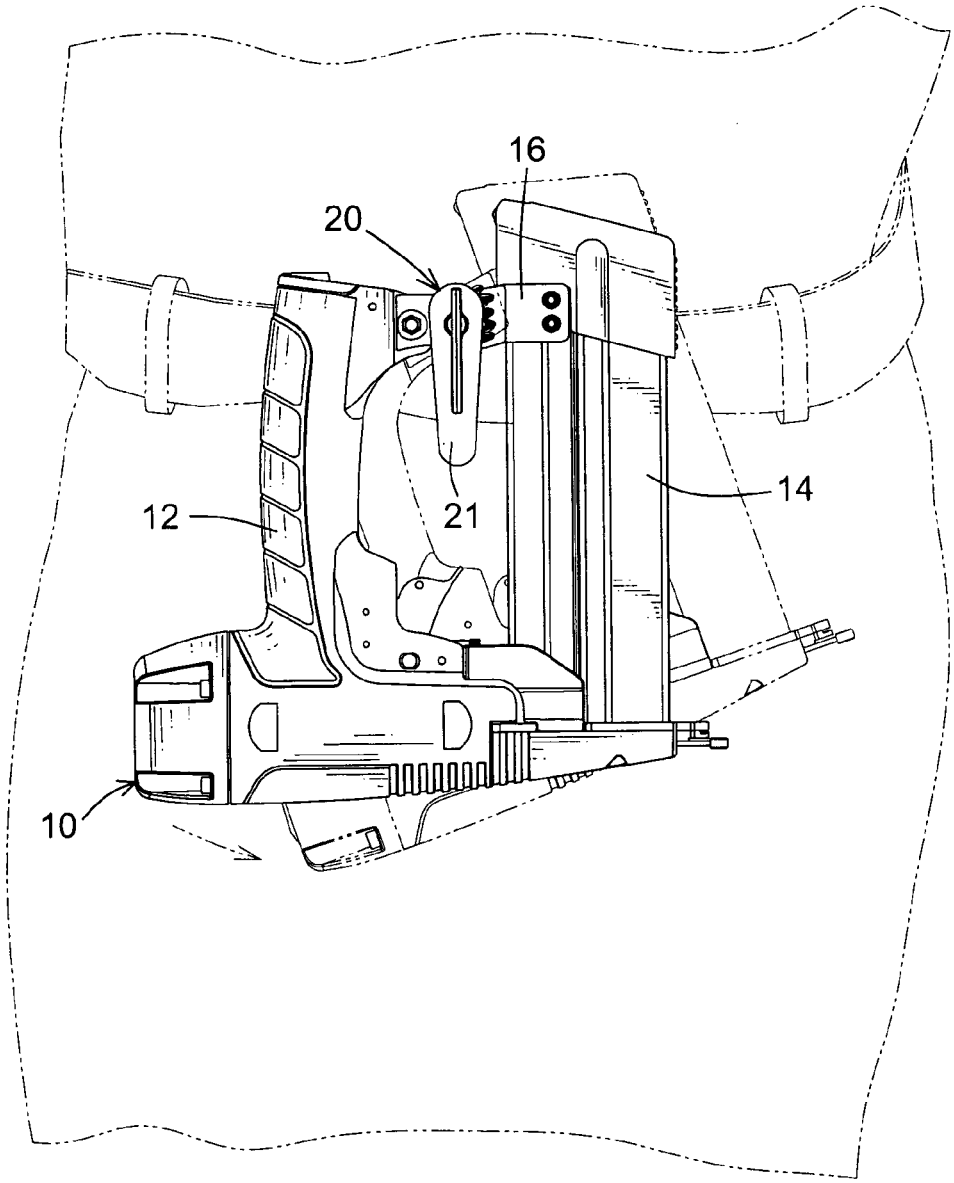
FIG. 3 is an operational side plan view of the nail gun with an adjustable clip assembly in FIG. 1 showing that the nail gun is hung on a user's waist belt with the clip assembly.

With reference to FIGS. 1 to 3, a nail gun in accordance with the present invention comprises a body (10), a handle (12), a nail magazine (14), a holding bar (16) and a clip assembly (20). The body (10) is hollow and has an internal mechanism contained in the body (10) and actuated by pressurized air. The handle (12) is formed on and extends from the body (10) to allow a user to grip the handle (10) when using the nail gun. The nail magazine (14) is attached to the body (10) for containing nails. The body (10) with the internal mechanism, the handle (12) and the nail magazine (14) may be a conventional one, and the detailed structures of the body (10) with the internal mechanism, the handle (12) and the nail magazine (14) are omitted.

The holding bar (16) is securely mounted between the handle (12) and the nail magazine (14) and comprises two ends, two sides, two mounting slots (17) and two U-shaped flanges (172). The ends are securely attached to the handle (12) and the nail magazine (14), respectively. The mounting slots (17) are defined respectively in two sides of the holding bar (16) to form a partition (162) between the slots (17). A through hole (164) is defined through the partition (162) and communicates with the slots (17). Each slot (17) extends to a side edge of the holding bar (16) to define an opening (171) in the side edge. The U-shaped flanges (172) are formed respectively on the sides of the holding bar (16) and are formed on and extend into the slots (17), respectively.

The clip assembly (20) is rotatably and detachably mounted to one of the mounting slots (17) in the holding bar (16) and comprises an axle (22), a clip (21), a positioning rod (24), a plug (27) and a biasing member (26). The axle (22) has a front end, a rear end, an annular groove (224), a front hole (222), a rear hole (223) and a rod hole (23). The annular groove (224) is defined around the axle (22) near the front end to form a head (225) on the front end. The front hole (222) is axially defined in the front end of the axle (22). The rear hole (223) is axially defined in the rear end of the axle (22). The rod hole (23) is T-shaped, is radially defined in the axle (22), communicates with the front hole (222) and the rear hole (223) and comprises a wide segment (232) and a narrow segment (234). Two flanges (235) formed on two sides of and extend into the narrow segment (234) to define a guiding slot (236) between the flanges (235).

The clip (21) is formed one and extends from the rear end of the axle (22) and has a bore (212) defined through the clip (21) and communicating with the rear hole (223) in the axle (22).

The positioning rod (24) is slidably held inside the narrow segment (234) of the rod hole (23) and comprises a front end, a rear end and a finger tab (25). The front end of the positioning rod (24) extend into and out of front hole (222) in the axle (22) and selectively extend into the through hole (164) in the partition (162) of the holding bar (16). The finger tab (25) is formed on and extends from the rear end of the positioning rod (24) and has a lower tab (252), a neck (254) and an upper tab (256). The lower tab (252) is connected to the rear end of the positioning rod (24) and is slidably held inside the narrow segment (234) of the rod hole (23). The neck (254) extends from the lower tab (252) and is slidably held inside the guiding slot (236). The upper tab (256) is formed on the neck (254) and has a diameter larger than the width of the guiding slot (236) to keep the positioning rod (24) from escaping from the rod hole (23) through the guiding slot (236).

The plug (27) is securely held inside the rear hole (223) and partially extends into the wide segment (232) of the rod hole (23). To securely hold the plug (27) inside the rear hole (223), a pin (272) radially into the axle (22) and through the plug (27) to keep the plug (27) from escaping from the rear hole (223).

The biasing member (26) may be a spring, is held inside the narrow segment (234) of the rod hole (23) and has two ends abutting respectively against the finger tab (25) on the positioning rod (24) and the plug (27). With the biasing force provided by the biasing member (26), the front end of the positioning rod (24) extends out of the front hole (222) and into the through hole (164) in the holding bar (16).

Figure 5:
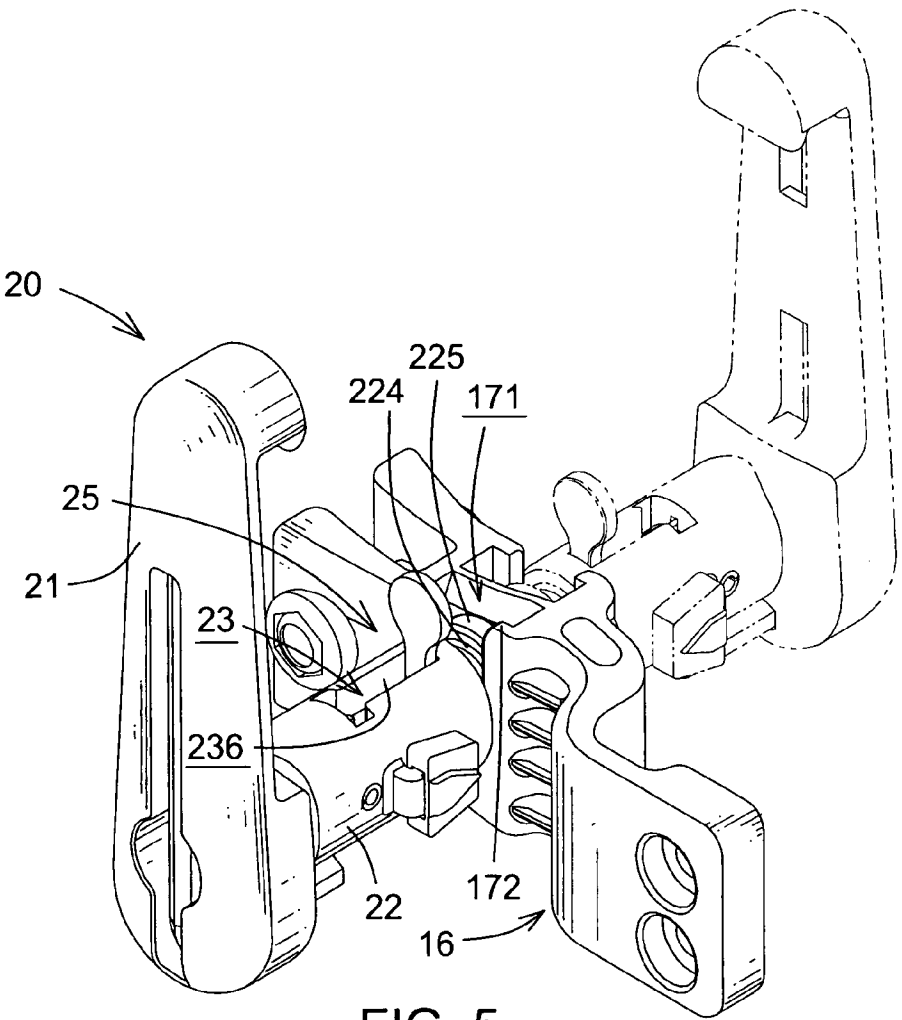
FIG. 5 is an operational perspective view of the clip assembly in FIG. 1.
Figure 6:
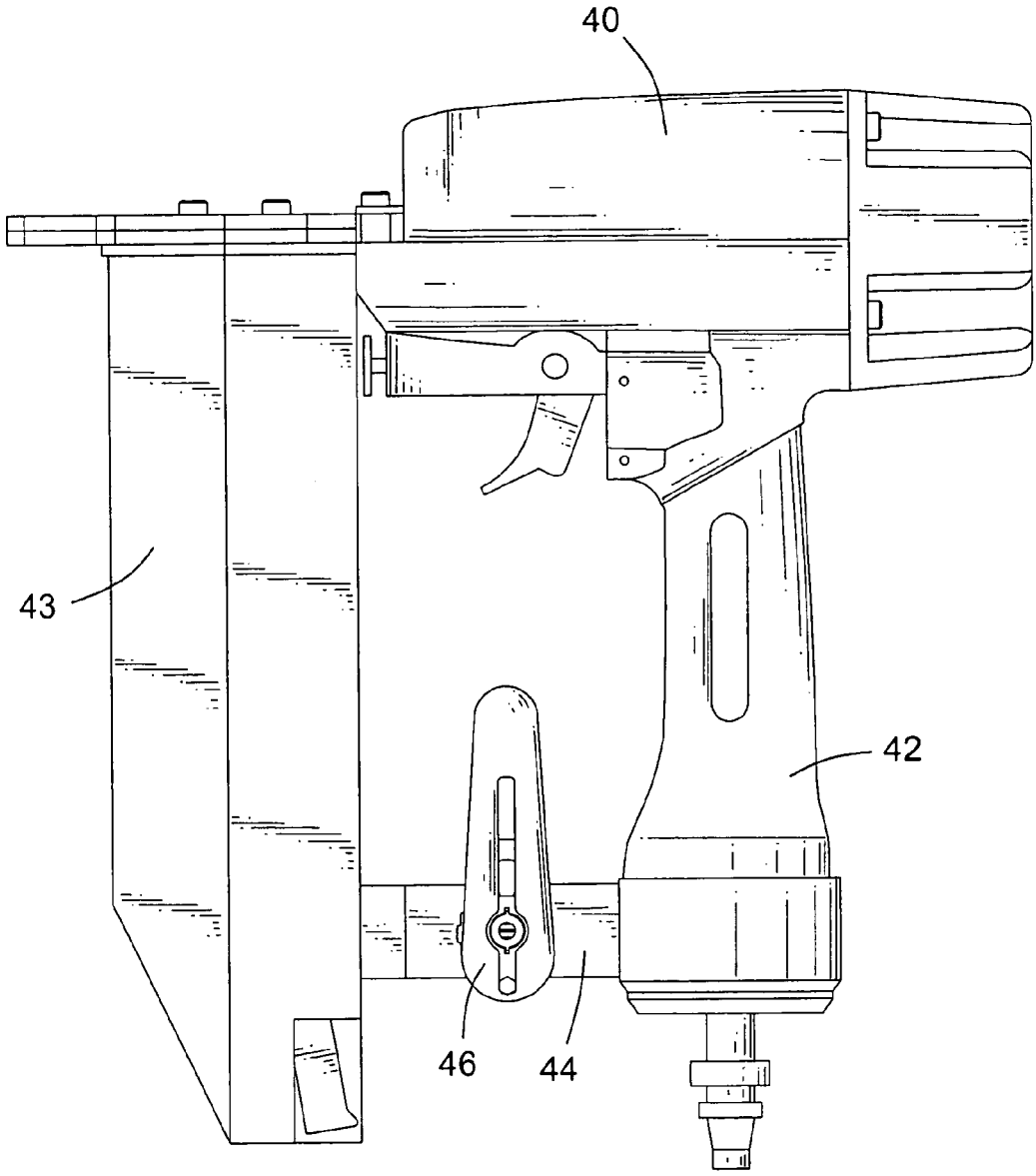
FIG. 6 PRIOR ART
FIG. 6 is a side plan view of a conventional nail gun with a clip in accordance with the prior art.

To attach the clip assembly (20) to the holding bar, with further reference to FIG. 5 the head (225) on the front end of the axle (22) is put into one of the mounting slots (17) on the holding bar (16) through the opening (171). The U-shaped flange (172) on the mounting slot (17) engages with the annular groove (224) on the axle (22) to hold the head (225) inside the mounting slot (17). When the axle (22) is attached into the mounting slot (17), the front end of the positioning rod (24) will automatically extend into the through hole (164) in the partition (162) with the biasing force provided by the biasing member (26). Accordingly, the axle (22) will not disengage from the mounting slot (17) due to the engagement between the front end of the positioning rod (24) and the through hole (164). With such a clip assembly (20), a user can hang the nail gun on his/her waist belt to conveniently carry the nail gun to any desired work location.

With the engagement between the U-shaped flange (172) and the annular groove (224) on the axle (22), the axle (22) can rotate relative to the holding bar (16) to adjust the position of the clip assembly (20) relative to the holding bar (16).

Figure 4:
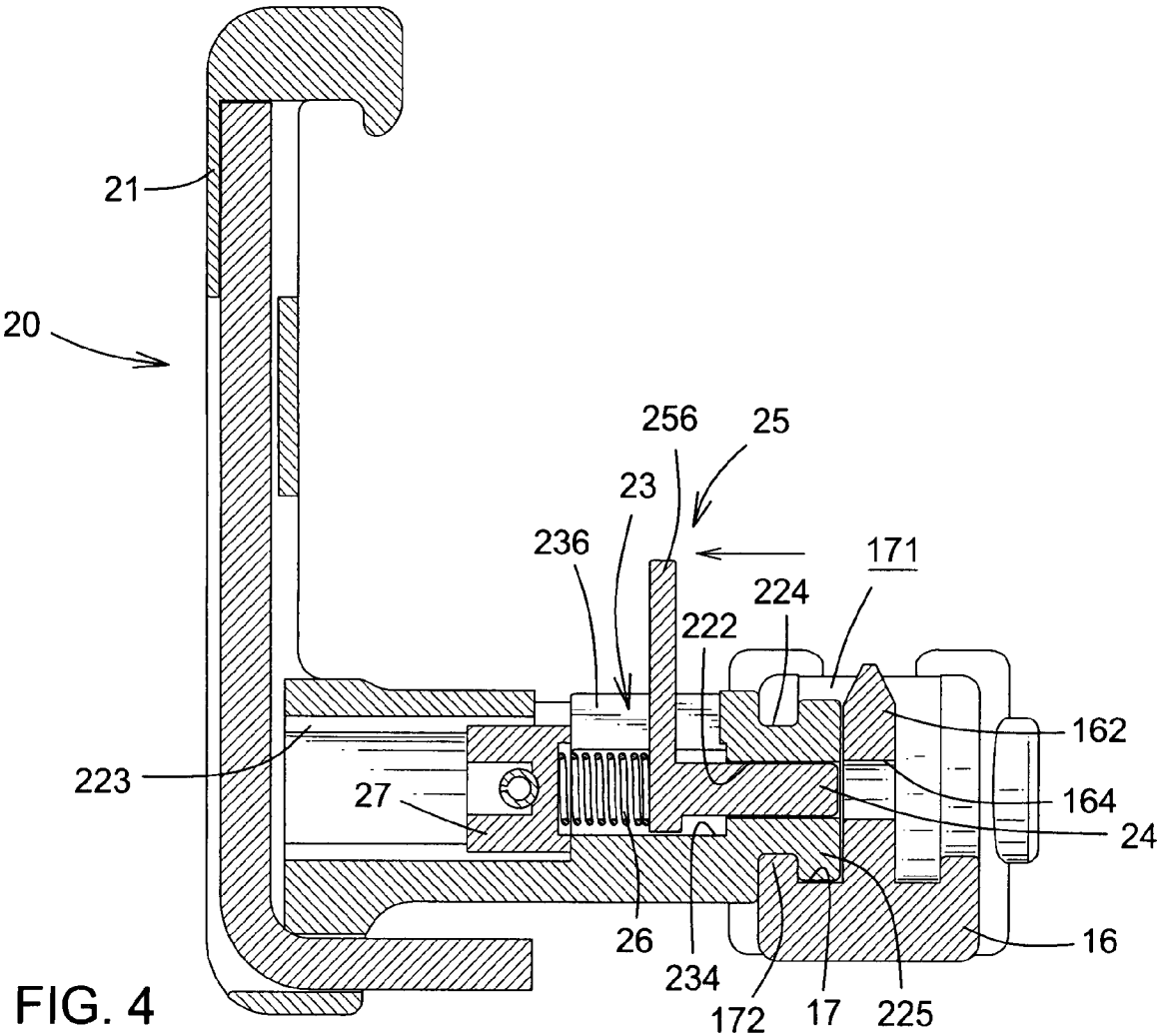
FIG. 4 is a cross sectional side plan view of the clip assembly in FIG. 2.

Furthermore, with reference to FIGS. 4 and 5, when the finger tab (25) is pulled to make the front end of the positioning rod (24) to escape from the through hole (164) in the partition (162), the neck (254) will slide along the guiding slot (236) and the axle (22) can be detached from the mounting hole (17) through the opening (171). Consequently, the axle (22) can be attached into the other mounting hole (17) to mount the clip assembly (20) at the other side of the holding bar (16). Therefore, a user can adjust the position of the clip assembly (20) based on his/her needs, and the nail gun with the clip assembly (20) in accordance with the present invention is versatile in use.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A nail gun comprising:

a body;

a handle formed on and extending from the body;

a nail magazine attached to the body for containing nails inside;

a holding bar mounted between the handle and the nail magazine and comprising two ends securely attached to the handle and the nail magazine, respectively; and two mounting slots defined respectively in two sides of the holding bar to form a partition between the slots, and each slot extending to a side edge of the holding bar to define an opening in the side edge, wherein a through hole is defined through the partition and communicates with the slots; and a clip assembly rotatably and detachably attached to one of the mounting slots in the holding bar and comprising:

an axle rotatably and detachably attached to one of the mounting slots in the holding bar and having a front end;

a rear end;

a front hole axially defined in the front end of the axle; and a rod hole radially defined in the axle and communicating with the front hole;

a clip formed on and extending from the rear end of the axle;

a positioning rod slidably held inside the rod hole and having a front end extending into and out of front hole in the axle and selectively extending into the through hole in the partition of the holding bar; and a biasing member held inside the rod hole and abutting against the positioning rod to provide a biasing force to the positioning rod.

2. The nail gun as claimed in claim 1, wherein the holding bar has two U-shaped flanges formed respectively on the sides of the holding bar and formed on and extending into the slots, respectively; and the axle has an annular groove defined around the axle near the front end to form a head on the front end; and the annular groove engages with a corresponding one of the U-shaped flanges when the axle is attach to a corresponding mounting slot.

3. The nail gun as claimed in claim 2, wherein the axle has a rear hole axially defined in the rear end of the axle and communicating with the rod hole;

the clip has a bore defined through the clip and communicating with the rear hole in the axle;

a plug is securely held inside the rear hole and partially extends into the rod hole; and the biasing member has two ends abutting respectively against the positioning rod and the plug.

4. The nail gun as claimed in claim 3, wherein the rod hole is T-shaped and comprises a wide segment and a narrow segment;

two flanges are formed on two sides of and extend into the narrow segment to define a guiding slot between the flanges; and the plug partially extends into the wide segment of the rod hole.

5. The nail gun as claimed in claim 4, wherein a finger tab is formed on and extends from the rear end of the positioning rod and comprises a lower tab connected to the rear end of the positioning rod and slidably held inside the narrow segment of the rod hole;

a neck extending from the lower tab and slidably held inside the guiding slot; and an upper tab formed on the neck and having a diameter larger than a width of the guiding slot to keep the positioning rod from escaping from the rod hole through the guiding slot.

6. The nail gun as claimed in claim 1, wherein the axle has a rear hole axially defined in the rear end of the axle and communicating with the rod hole;

the clip has a bore defined through the clip and communicating with the rear hole in the axle;

a plug is securely held inside the rear hole and partially extends into the rod hole; and the biasing member has two ends abutting respectively against the positioning rod and the plug.

7. The nail gun as claimed in claim 6, wherein the rod hole is T-shaped and comprises a wide segment and a narrow segment;

two flanges are formed on two sides of and extend into the narrow segment to define a guiding slot between the flanges; and the plug partially extends into the wide segment of the rod hole.

8. The nail gun as claimed in claim 7, wherein a finger tab is formed on and extends from the rear end of the positioning rod and comprises a lower tab connected to the rear end of the positioning rod and slidably held inside the narrow segment of the rod hole;

a neck extending from the lower tab and slidably held inside the guiding slot; and an upper tab formed on the neck and having a diameter larger than a width of the guiding slot to keep the positioning rod from escaping from the rod hole through the guiding slot.

9. The nail gun as claimed in claim 1, wherein the rod hole is T-shaped and comprises a wide segment and a narrow segment;

two flanges are formed on two sides of and extend into the narrow segment to define a guiding slot between the flanges.

10. The nail gun as claimed in claim 9, wherein a finger tab is formed on and extends from the rear end of the positioning rod and comprises a lower tab connected to the rear end of the positioning rod and slidably held inside the narrow segment of the rod hole;

a neck extending from the lower tab and slidably held inside the guiding slot; and an upper tab formed on the neck and having a diameter larger than a width of the guiding slot to keep the positioning rod from escaping from the rod hole through the guiding slot.

* * * * *